US011668154B2

(12) United States Patent
Araujo

(10) Patent No.: US 11,668,154 B2
(45) Date of Patent: Jun. 6, 2023

(54) VARIABLE BORE RAM ASSEMBLY

(71) Applicant: WORLDWIDE OILFIELD MACHINE, INC., Houston, TX (US)

(72) Inventor: Raul Araujo, Cypress, TX (US)

( * ) Notice: Subject to any disclaimer, the term of this patent is extended or adjusted under 35 U.S.C. 154(b) by 103 days.

(21) Appl. No.: 17/141,442

(22) Filed: Jan. 5, 2021

(65) Prior Publication Data

US 2021/0207451 A1 Jul. 8, 2021

Related U.S. Application Data

(60) Provisional application No. 62/957,561, filed on Jan. 6, 2020.

(51) Int. Cl.
*E21B 33/06* (2006.01)

(52) U.S. Cl.
CPC ..... *E21B 33/062* (2013.01)

(58) Field of Classification Search
CPC ..... E21B 33/062
USPC ..... 251/1.1, 1.2, 1.3
See application file for complete search history.

(56) References Cited

U.S. PATENT DOCUMENTS

| | | | | |
|---|---|---|---|---|
| 6,089,526 | A | 7/2000 | Olson | |
| 6,367,804 | B1 | 4/2002 | Watts | |
| 6,394,460 | B1 | 5/2002 | Leggett et al. | |
| 6,857,634 | B2 | 2/2005 | Araujo | |
| 6,955,357 | B2 * | 10/2005 | Griffin | E21B 33/062 251/1.2 |
| 6,974,135 | B2 | 12/2005 | Melancon | |
| 7,849,599 | B2 * | 12/2010 | Huff | B23K 9/167 148/622 |
| 8,544,538 | B2 * | 10/2013 | Weir | E21B 33/062 166/85.4 |
| 9,580,988 | B2 | 2/2017 | Bleck et al. | |
| 10,094,193 | B2 | 10/2018 | Araujo et al. | |
| 2004/0113108 | A1 * | 6/2004 | Ward | E21B 33/062 251/1.3 |
| 2016/0215583 | A1 * | 7/2016 | Cantlon | E21B 33/064 |
| 2017/0145771 | A1 * | 5/2017 | Araujo | E21B 33/062 |
| 2017/0167219 | A1 * | 6/2017 | Wang | E21B 33/062 |

FOREIGN PATENT DOCUMENTS

DE 3249848 C2 * 2/1990

OTHER PUBLICATIONS

DE-3249848-C2 Machine Translation, Jones, 1990 (Year: 1990).*

* cited by examiner

*Primary Examiner* — Daphne M Barry
(74) *Attorney, Agent, or Firm* — Kenneth L. Nash; Thomas D. Nash

(57) ABSTRACT

In summary, the present invention provides a variable bore ram assembly comprising a first ram and a second ram defining a central circular recess along the same axis as a wellbore. A plurality of packing members and support inserts form first and second packer assemblies define an interlocking connection to surround a tubular good, thereby sealing the wellbore. The rams have been designed to remove common contacts points with the inner wall of the ram cavity to withstand deformation. The first and second ram assemblies have inner sealing faces with cutout portions of elastomeric material to provide additional space for material during a close operation.

11 Claims, 7 Drawing Sheets

VARIABLE BORE RAM ASSEMBLY

BACKGROUND

Field of the Invention

The present invention relates generally to BOP rams and, more particularly, to an improved variable bore ram assembly.

Background of the Invention

Blowout Preventer (BOP) stacks are frequently utilized in oilfield wellbore Christmas trees and subsea intervention operations. BOP stacks may include a first set of rams for sealing off the wellbore and a second set of rams for cutting pipe such as tubing, wireline and/or intervention tools. A BOP comprises two ram blocks that open and close to allow access or seal the wellbore through the BOP. Large-diameter hydraulic cylinders, normally retracted, force the two ram blocks together in the middle to seal the wellbore. The ram blocks are constructed of steel for strength and fitted with elastomer components on the sealing surfaces. The ram blocks are available in a variety of configurations. In some designs, they are flat at the mating surfaces to enable them to seal over an open wellbore. Other designs have a circular cutout in the middle that corresponds to the diameter of the pipe in the hole to seal the well when pipe is in the hole.

An example ram BOP includes a main body or housing with a vertical bore. Ram bonnet assemblies may be bolted to opposing sides of the main body using a number of high tensile fasteners, such as bolts or studs. These fasteners are required to hold the bonnet in position to enable the sealing arrangements to work effectively. An elastomeric sealing element may be used between the ram bonnet and the main body. There are several configurations, but essentially they are all directed to preventing a leakage bypass between the mating faces of the ram bonnet and the main body. Each bonnet assembly includes a piston which is laterally movable within a ram cavity of the bonnet assembly by pressurized hydraulic fluid acting on one side of the piston. The opposite side of each piston has a connecting rod attached thereto which in turn has a ram mounted thereon. The rams can be pipe rams for sealing off around an object within the bore of a BOP, such as a pipe, thereby sealing the annular space between the object and the BOP bore.

The rams are designed to move laterally toward the vertical bore of the BOP to seal off on any object located therein. For instance, opposing pipe rams utilize seals that close in on and seal off on a tubular within the vertical bore of the BOP, such as a section of drill pipe used during drilling operations. Each pipe ram typically has a semicircular opening in its front face to form a seal about half of the outer periphery of the object within the BOP vertical bore. When the opposing pipe rams are closed, the opposing pipe rams engage each other and seal the entire periphery of the object, thereby closing off the annulus between the object and the BOP bore. Typical pipe ram assemblies can include a ram packer that is composed of an elastomeric or rubber material configured to seal off against the tubular within the vertical bore of the BOP when the opposing rams are run into the closed position. However, in certain embodiments, the elastomeric material may become damaged when the rams are moving within the BOP housing and sealing upon objects within the BOP bore, such as by having the elastomeric material extrude and clipped or cut off when sealing and/or moving within the BOP.

Consequently, those skilled in the art will appreciate the present invention that addresses the above problems.

SUMMARY OF THE INVENTION

An object of the present invention is to provide an improved variable bore ram assembly.

Another possible object of the present invention is to provide an improved variable bore ram assembly with increased shearing capabilities and seal performance.

Yet another possible object of the present invention is to provide an improved variable bore ram assembly that causes less damage to ram cavity during normal operation, therefore requiring less maintenance.

Yet another possible object of the present invention is to provide an improved variable bore ram assembly with an improved bore geometry to minimize damage to the packer assembly body.

One general aspect includes a variable bore ram assembly mounted inside a bop (blowout preventer) to seal a wellbore. The variable bore ram assembly also includes a first ram and a second ram that mount within said ram cavities on opposite sides of said bore through said bop; a first packer assembly on said first ram may include an elastomeric body with a plurality of packing members contained within an upper shoulder and a lower shoulder of said first ram. The assembly also includes a second packer assembly on said second ram may include an elastomeric body with a plurality of packing members contained within an upper shoulder and a lower shoulder of said second ram. The assembly also includes a first pair of support inserts supporting said first packer assembly within said first ram and a second pair of support inserts supporting said second packer assembly within said second ram. The assembly also includes said first packer assembly and said second packer assembly each defining an inner sealing face with a cutout portion. Other embodiments of this aspect include corresponding computer systems, apparatus, and computer programs recorded on one or more computer storage devices, each configured to perform the actions of the methods.

Implementations may include one or more of the following features. The variable bore ram assembly where said first and second rams defining a generally oval shape with scalloped portions on lower corners of said first and second rams. Said first ram further may include a first top seal and said second ram further may include a second top seal. Said first pair of support inserts secures said first packer assembly to said first top seal and said second pair of support inserts secures said second packer assembly to said second top seal. Said cutout portion may include one of a generally triangular, semicircular, oval, or rectangular shape. Said upper shoulder and said lower shoulder on said first ram and said upper shoulder and said lower shoulder on said second ram may include packer material. Said packing members may include a generally triangular shape. Said first and second pair of support inserts are may include of 74 ksi steel. Said first and second pairs of support inserts each may include a vertical stem defined by an upper face and a lower face on opposite sides of said vertical stem, said upper face and said lower face flush with said ram cavities. Said first and second pairs of support inserts each further may include a horizontal appendage extending from a middle portion of said vertical stem. variable bore ram assembly and method. Implementations of the described techniques may include hardware, a method or process, or computer software on a computer-accessible medium.

BRIEF DESCRIPTION OF THE DRAWINGS

The following detailed description and claims are merely illustrative of the generic invention. Additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein:

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1A:
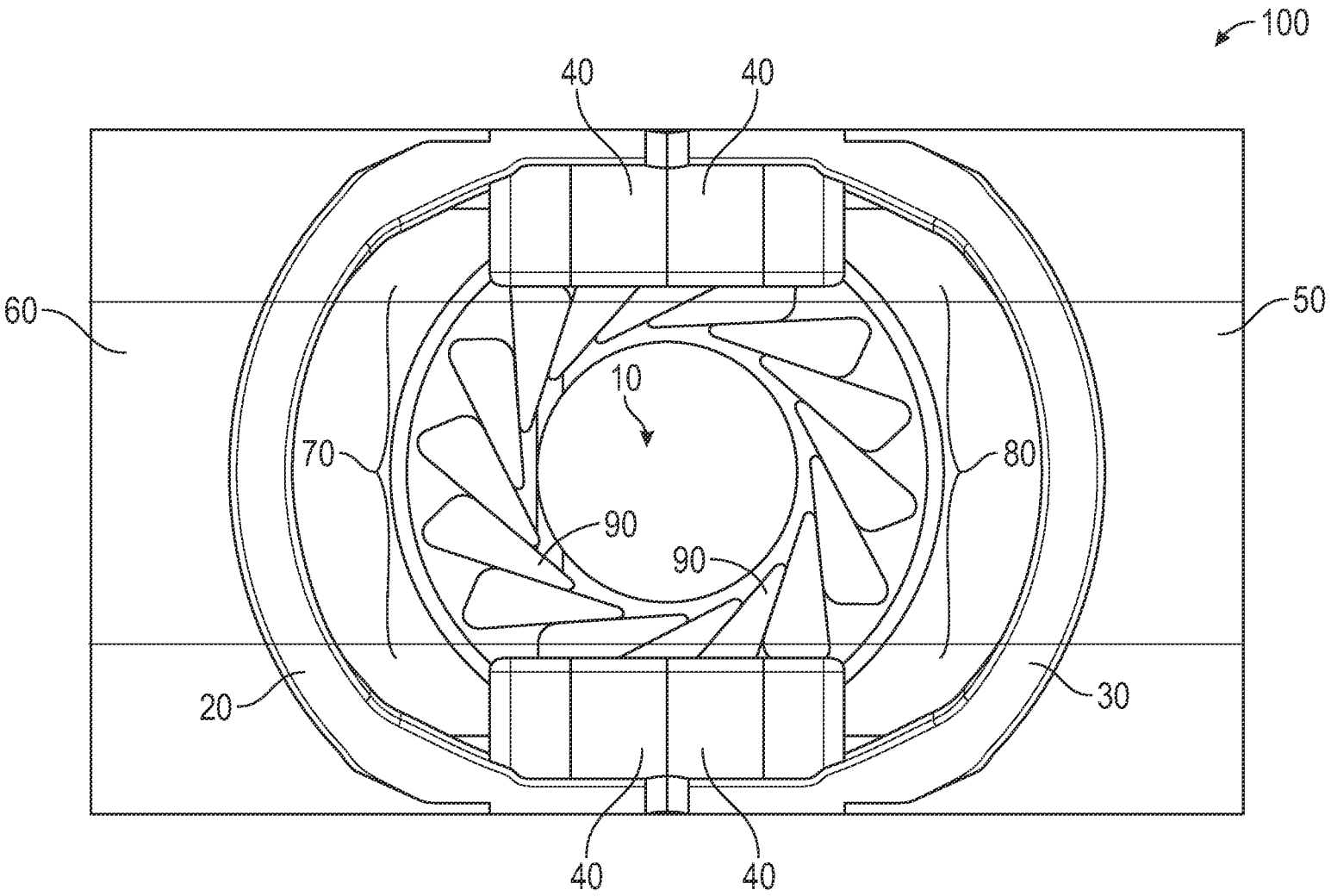
FIG. 1A is a top view of a variable bore ram assembly in accord with one embodiment of the present invention.
Figure 1B:
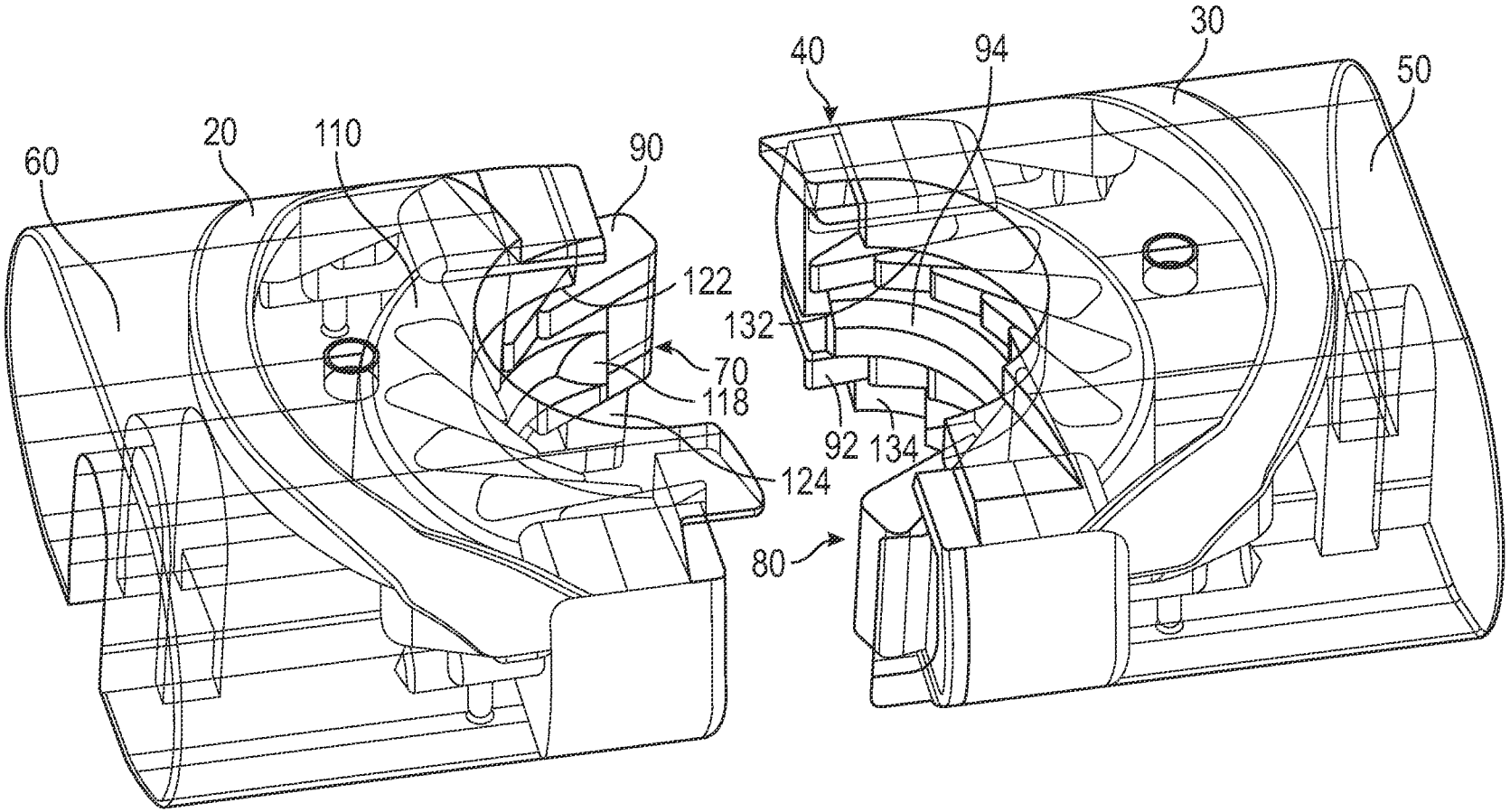
FIG. 1B is a perspective view, partially in section, of a variable bore ram assembly in accord with one embodiment of the present invention.

Turning to FIGS. 1A and 1B, variable bore ram assembly 100 is shown as used with a standard BOP assembly. In a preferred embodiment, the present invention is operable with ram assemblies for well control operations in the 3½" to 7" range. Other embodiments may encompass other ranges for desired well control operations. Variable bore ram assembly 100 comprises one pair of I-beam inserts 40 defining part of first packer assembly 70 on ram block 50 and one pair of I-beam inserts 40 defining part of packer assembly 80 on ram block 60. Packer assembly 70 is positioned between upper shoulder 122 and lower shoulder 124 on ram block 60.

Similarly, packer assembly 80 is positioned between upper shoulder 132 and lower shoulder 134 on ram block 50 opposite packer assembly 70 with respect to bore 10. I-beam inserts 40 support outer portions of packer assemblies 70 and 80 respectively, facing opposite each other with respect to the bore 10. I-beam inserts 40 are positioned to better contain forces during operation and prevent damage to the ram cavity. Asymmetrical cut 118 in elastomeric body 130 provides additional volume for the body to expand whereby it does not get clipped while the elastomer extrudes during a close and seal operation. Packer assemblies 70 and 80 are designed to be replaced when damaged or worn during operations.

Figure 2:
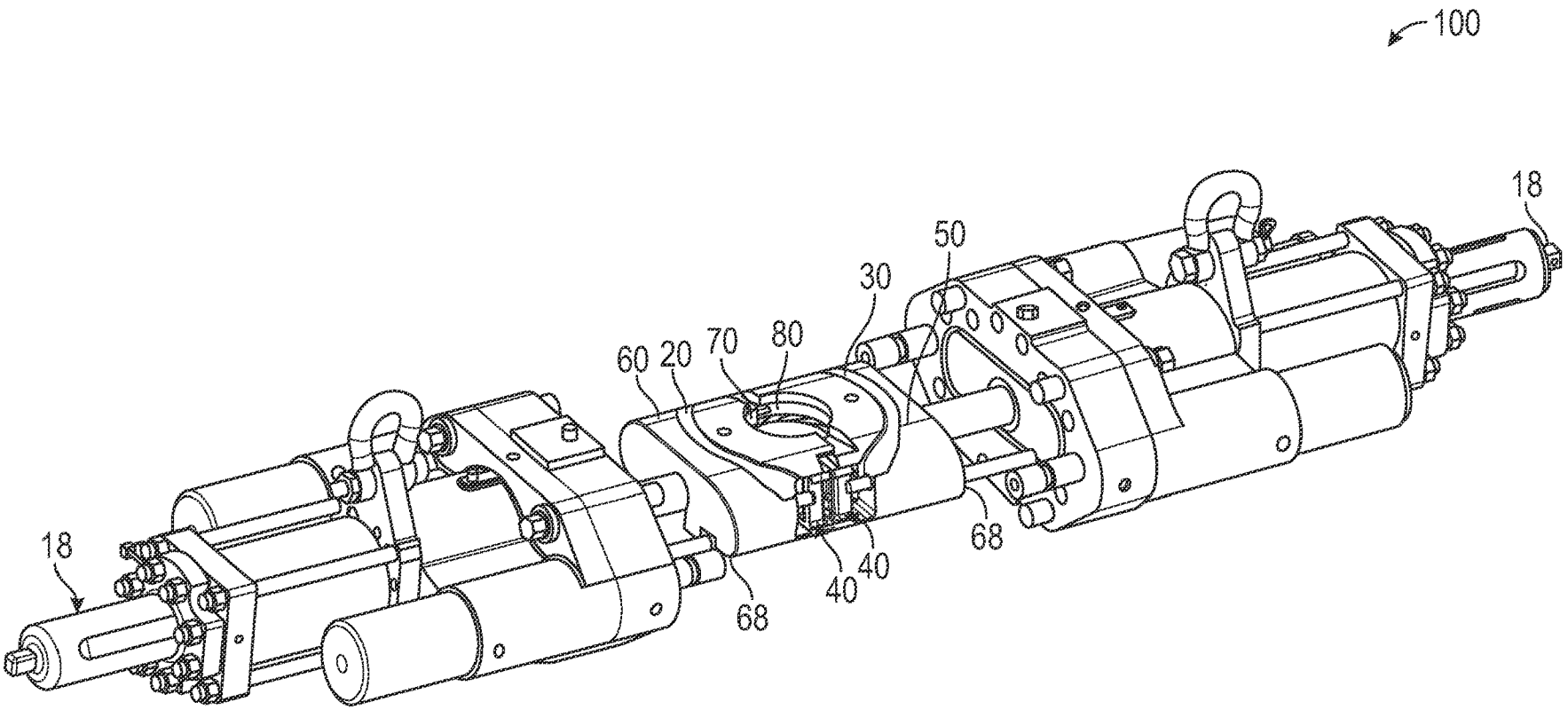
FIG. 2 is a perspective view of a variable bore ram BOP in accord with one embodiment of the present invention.

Variable bore ram BOP assembly 100 or VBR 100 is shown as used in one possible embodiment of a well control intervention system with the BOP housing removed in FIG. 2. VBR 100 comprises a housing which defines an inner ram cavity that houses first ram block 50 and second ram block 60 on opposite sides of wellbore 10. Two actuating means 18, which may comprise hydraulic pistons or the like, are engaged with VBR 100 to move first and second rams 50 and 60 towards and away from wellbore 10 during operation. VBR 100 is able to provide isolation or sealing of the wellbore when the BOP is closed.

Referring now to FIG. 4 and FIGS. 5A-5C, packer assembly 70 and 80 are shown in more detail. It should be understood that packer assembly 70 is identical to packer assembly 80, but only one will be described in detail herein. Variable bore ram assembly packer is shown with a plurality of packing elements which surround the bore. Elastomeric body 130 has a curved central body 108 with end pieces 110 opposite each other with respect to curved central body 108. Packer assembly 70 comprises a plurality of packer inserts 90 arranged on an upper portion of assembly 70 and a plurality of packer inserts 92 arranged on a lower portion of packer assembly 70 arranged in a semicircular pattern corresponding with curved housing 108. Packer inserts 90 and 92 are generally triangular shaped, but they could be shaped differently consistent with the teachings herein. Inserts 40 are chemically bonded within end pieces 110 of elastomeric body 130. As discussed herein, Elastomeric body 130 surrounds and is chemically bonded with packer inserts 90 and 92 to form an inner diameter face 94 which makes a sealing engagement with the OCTG in bore 10 during a close operation. During operation, packer inserts 90 and 92 rotate radially inward as packer assemblies 70 and 80 engage and surround the OCTG in bore 10. Asymmetrical cut 118 is present on only one side of inner diameter face 94 which results in controlling the extrusion of elastomer by providing a volume in which the elastomer body 130 may expand when the VBR 100 performs a close sealing operation.

The bore geometry prevents elastomer clipping during a close operation on drill pipe and pressure holds. The packing elements have an asymmetrical cut to provide additional volume for the elastomer to occupy and prevent the elastomer from bulging during a ram close operation. In this way, the elastomeric material of the packers may be made narrower and/or effect better seals under pressure with less likelihood of damage. In this case, elastomeric packer material is positioned between upper inserts 90 and lower inserts 92 that are harder than the elastomeric packer material and may be metallic. This configuration is utilized throughout the packer assembly 70 and/or 60 so that the inserts 90 and 92 form a lining for the whole or most of packers 70 and 80. This will reduce the extrusion of elastomer during the fatigue test which will increase the packer durability.

Figure 3C:
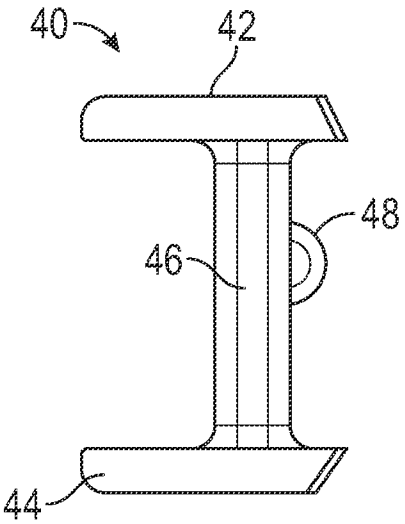
FIG. 3C is an end view of an I-beam insert for a variable bore ram assembly in accord with one embodiment of the present invention
Figure 3B:
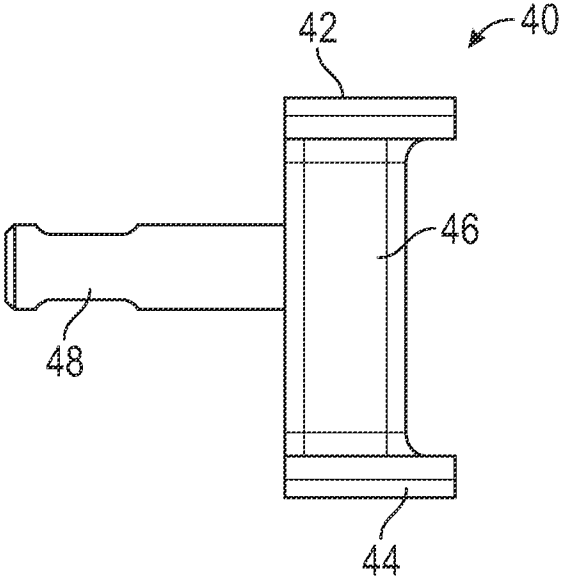
FIG. 3B is an side view of an I-beam insert for a variable bore ram assembly in accord with one embodiment of the present invention
Figure 3A:
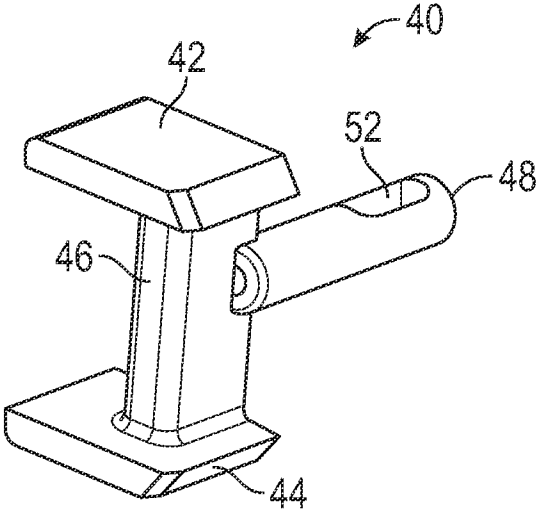
FIG. 3A is a perspective view of an I-beam insert for a variable bore ram assembly in accord with one embodiment of the present invention.
Figure 4:
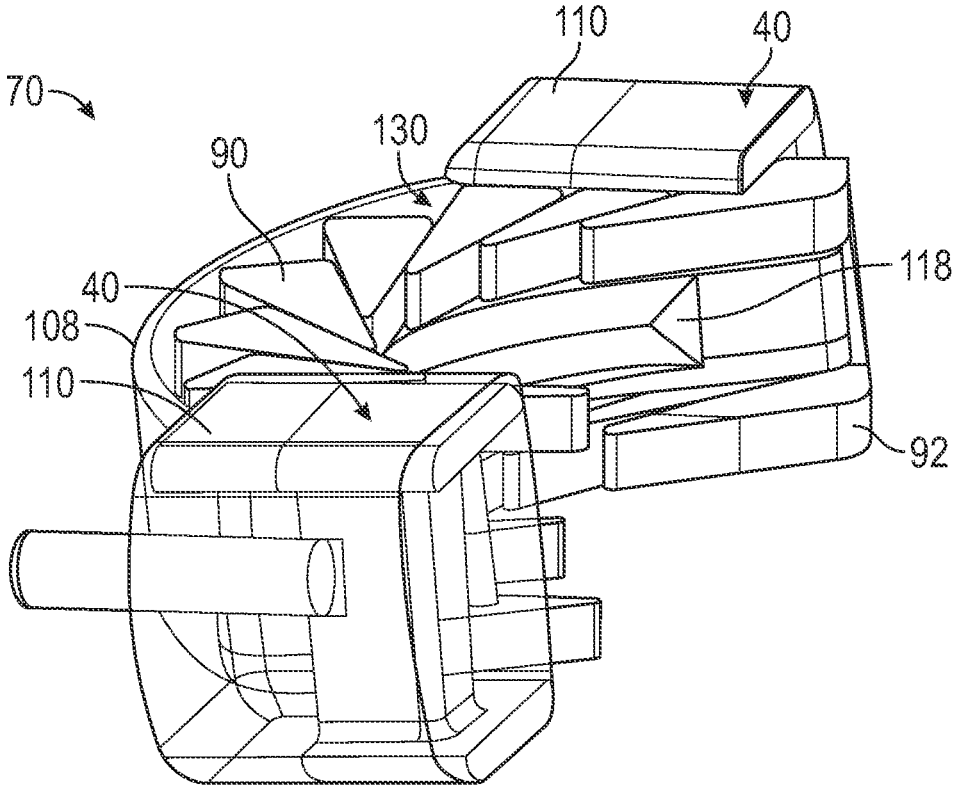
FIG. 4 is a perspective view of a packer assembly for a variable bore ram assembly in accord with one embodiment of the present invention.
Figure 5A:
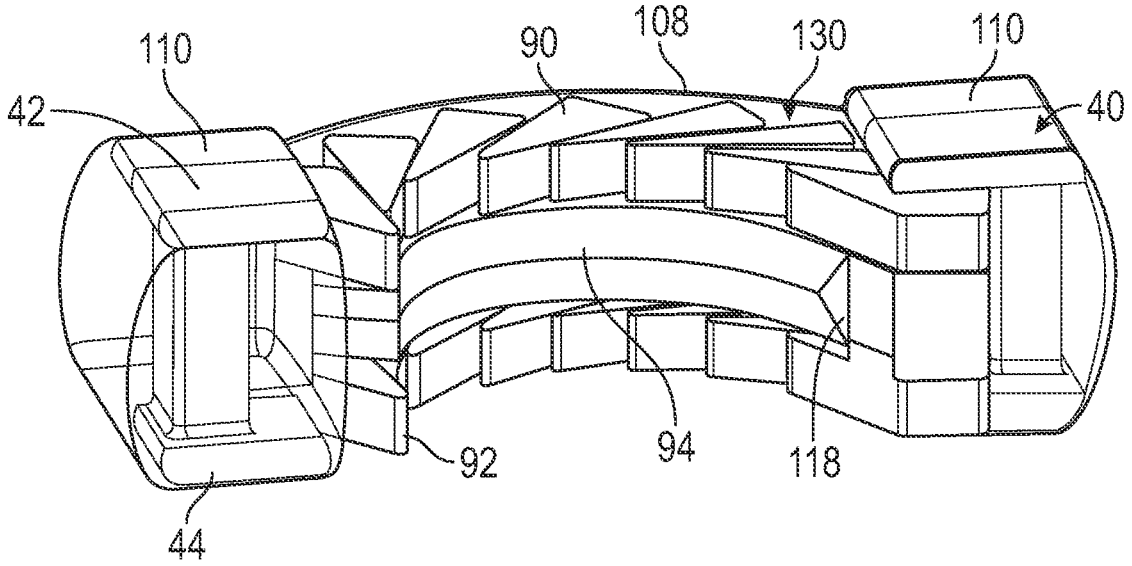
FIG. 5A is a perspective view of the bore geometry for a variable bore ram assembly in accord with one embodiment of the present invention.
Figure 5B:
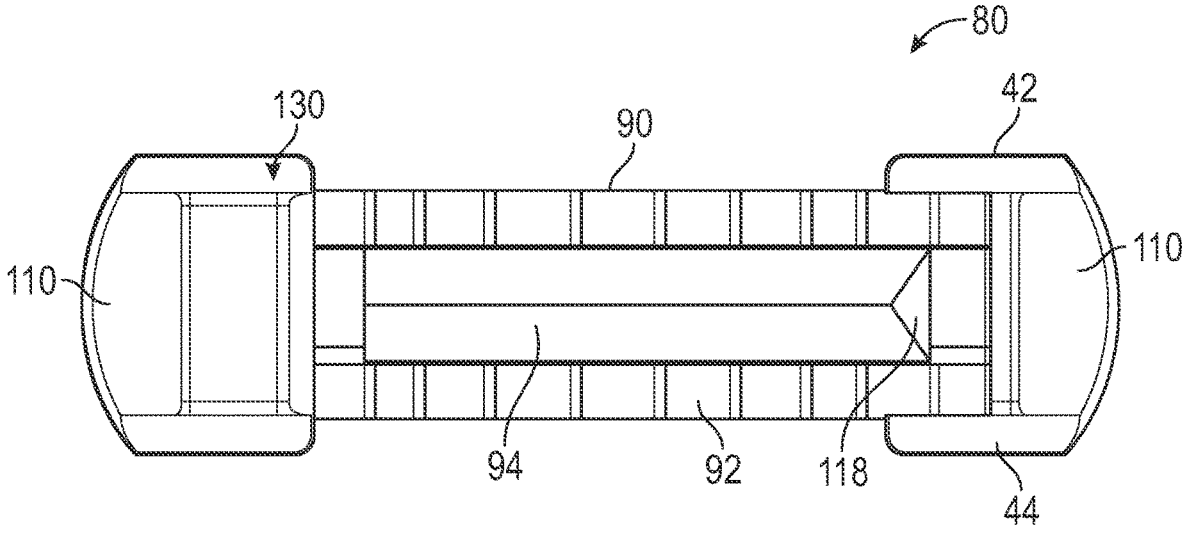
FIG. 5B is a side view of the bore geometry for a variable bore ram assembly in accord with one embodiment of the present invention.
Figure 5C:
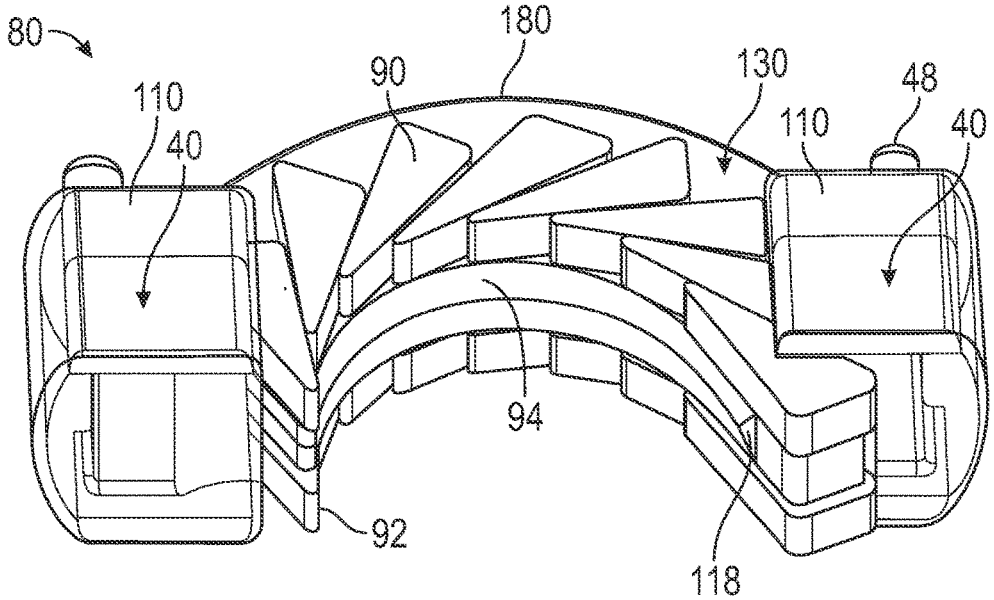
FIG. 5C is a top view the bore geometry for a variable bore ram assembly in accord with one embodiment of the present invention.

I-beam inserts 40 used in the variable bore ram assembly 100 are shown in more detail in FIGS. 3A-3C. The I-beam inserts 40 comprise a vertical stem 46 and a horizontal portion 48 extending from a midsection of the vertical stem 46. The vertical stem 46 is defined by an upper end 42 and a lower end 44 that are flush with the ram cavity during operation. In a preferred embodiment, inserts 40 are 74 ksi steel, though other material may be used provided they have a stronger force tolerance than elastomeric body 130. The horizontal portion 48 may also comprise recess 52, which may in some embodiments mate with top seal 20 and tops seal 30 as shown in FIG. 1B. In other embodiments, recess 52 may provide additional surface area for elastomeric body 130 to chemically bond with. The inserts 40 prevent deformation and elastomer loading on the top of the ram cavity when rams 50 and 60 are performing a close operation, thereby minimizing damage to the ram cavity. The inserts are designed to remove vertical loading from the elastomer pressure on body 130 and direct the pressure to the vertical plane. This ultimately extends the VBR packer fatigue life thereby requiring less down time and maintenance during operations.

Figure 6:
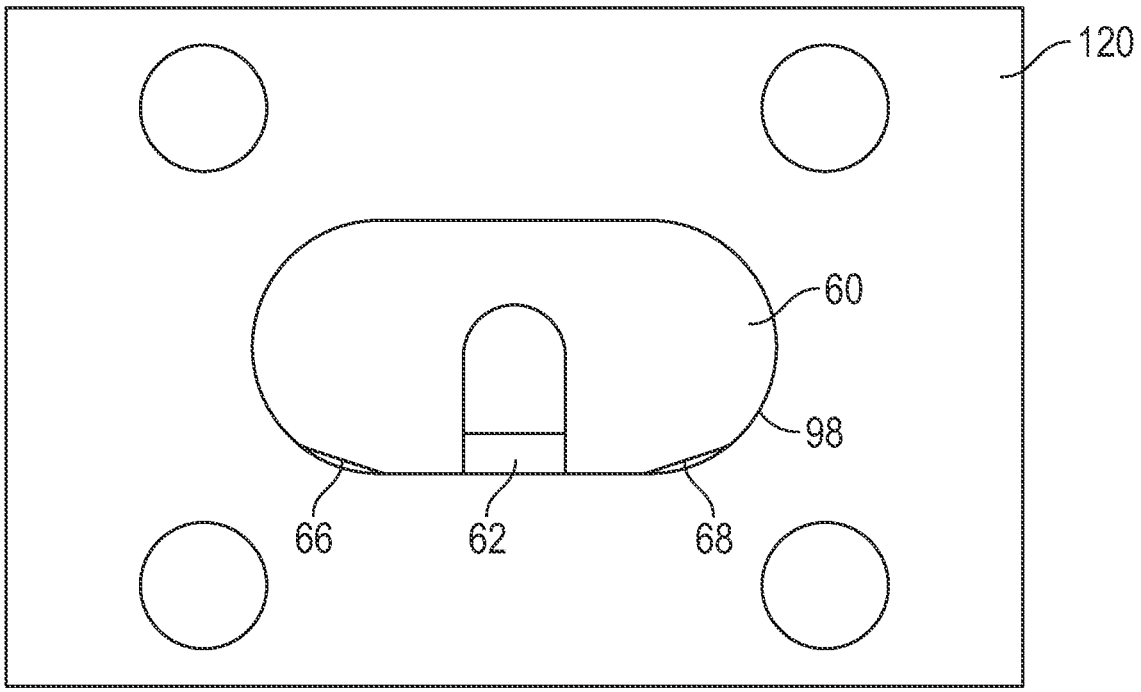
FIG. 6 is an end view of a ram block for a variable bore ram assembly in accord with one embodiment of the present invention.

In FIG. 6, variable bore ram assembly is shown with a focus on the ram block 60. Ram block 60 lower sides are redesigned with cutout portions 66 and 68 to remove contact areas with BOP housing 120 and ram cavity 98 that can cause interference and cause damage to ram cavity inner wall 98. Furthermore, ram block 60 has recess 62 a lower portion of ram block 60 rather than an upper portion.

In summary, the present invention provides a variable bore ram assembly comprising a first ram and a second ram defining a central circular recess along the same axis as a wellbore. A plurality of packing members and support inserts form first and second packer assemblies define an interlocking connection to surround a tubular good, thereby sealing the wellbore. The rams have been designed to remove common contacts points with the inner wall of the ram cavity to withstand deformation. The first and second ram assemblies have inner sealing faces with cutout portions of elastomeric material to provide additional space for material during a close operation.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A variable bore ram assembly mounted inside a BOP (blowout preventer) to seal a wellbore, said BOP comprising a bore through said BOP, said BOP further comprising ram cavities on either side of said bore, said ram cavities intersecting with said bore, said variable bore ram assembly comprising:

a first ram and a second ram that mount within said ram cavities on opposite sides of said bore through said BOP;

a first packer assembly on said first ram comprising a first elastomeric body with a plurality of packing members contained within an upper shoulder and a lower shoulder of said first ram;

a second packer assembly on said second ram comprising a second elastomeric body with a plurality of packing members contained within an upper shoulder and a lower shoulder of said second ram;

a first pair of support inserts supporting said first packer assembly within said first ram and a second pair of support inserts supporting said second packer assembly within said second ram;

said first packer assembly and said second packer assembly each defining an inner elastomeric sealing face for sealing said bore; and said first and second rams defining a generally oval shape for sliding engagement with said ram cavities, said generally oval shape defining a cutout portion on each lower corner of said first and second rams whereby each said lower corner does not engage said ram cavities adjacent said cutout portion.

2. The variable bore ram assembly of claim 1, wherein said first ram further comprises a first top seal and said second ram further comprises a second top seal.

3. The variable bore ram assembly of claim 2, said first and second pair of support inserts each comprise a vertical stem defined by an upper face and a lower face on opposite sides of said vertical stem, said upper face and said lower face being flush with said ram cavities, said first and second pair of support inserts each further comprise a horizontal appendage extending from a middle portion of said vertical stem, each said horizontal appendage comprising a recess, wherein said first top seal and said second top seal each being connected to said recess of each horizontal appendage.

4. The variable bore ram assembly of claim 1, wherein said cutout portion comprises one of a generally triangular, semicircular, oval, or rectangular shape.

5. The variable bore ram assembly of claim 1, wherein said upper shoulder and said lower shoulder on said first ram and said upper shoulder and said lower shoulder on said second ram comprise packer material.

6. The variable bore ram assembly of claim 1, wherein said packing members comprise a generally triangular shape.

7. The variable bore ram assembly of claim 1, wherein said first and second pair of support inserts are comprised of steel.

8. The variable bore ram assembly of claim 1, wherein said first and second pair of support inserts each comprise a vertical stem positioned between an upper face and a lower face on opposite sides of said vertical stem, said upper face and said lower face being flush with said ram cavities, said upper face and said lower face each being metallic.

9. The variable bore ram assembly of claim 8, wherein said first and second pair of support inserts being chemically bonded to respective of said first and second elastomeric bodies.

10. A variable bore ram assembly mounted inside a BOP (blowout preventer) to seal a wellbore, said BOP comprising a bore through said BOP, said BOP further comprising ram cavities on either side of said bore, said ram cavities intersecting with said bore, said variable bore ram assembly comprising:

a first ram and a second ram that mount within said ram cavities on opposite sides of said bore through said BOP;

a first packer assembly on said first ram comprising a first elastomeric body with a plurality of packing members contained within an upper shoulder and a lower shoulder of said first ram;

a second packer assembly on said second ram comprising a second elastomeric body with a plurality of packing members contained within an upper shoulder and a lower shoulder of said second ram;

a first pair of support inserts supporting said first packer assembly within said first ram and a second pair of support inserts supporting said second packer assembly within said second ram; and wherein said first and second rams define a generally oval shape for engagement with said ram cavities, said generally oval shape defining a cutout portion on each lower corner of said first and second rams whereby each said lower corner does not engage said ram cavities adjacent said cutout portion on each lower corner of said first and second rams.

11. The variable bore ram assembly of claim 10, said first packer assembly and said second packer assembly each defining an inner elastomeric sealing face for sealing said bore, said inner elastomeric sealing face comprising a cutout portion that cuts into said inner elastomeric sealing face, said cutout portion being located on only one side of each said inner elastomeric sealing face.

* * * * *